US010030384B2

(12) United States Patent
Gosling et al.

(10) Patent No.: US 10,030,384 B2
(45) Date of Patent: Jul. 24, 2018

(54) MODULAR WRAP AROUND WALL

(71) Applicant: DIRTT Environmental Solutions, Ltd., Calgary (CA)

(72) Inventors: Geoff W. Gosling, Calgary (CA); Mogens F. Smed, DeWinton (CA)

(73) Assignee: DIRTT ENVIRONMENTAL SOLUTIONS, LTD, Calgary, CA (US)

( * ) Notice: Subject to any disclaimer, the term of this patent is extended or adjusted under 35 U.S.C. 154(b) by 0 days.

(21) Appl. No.: 14/426,970

(22) PCT Filed: Nov. 10, 2014

(86) PCT No.: PCT/US2014/064856

§ 371 (c)(1),
(2) Date: Mar. 9, 2015

(87) PCT Pub. No.: WO2015/077075

PCT Pub. Date: May 28, 2015

(65) Prior Publication Data

US 2016/0251851 A1 Sep. 1, 2016

Related U.S. Application Data

(60) Provisional application No. 61/906,656, filed on Nov. 20, 2013.

(51) Int. Cl.

| | |
|---|---|
| ***E04B 2/82*** | (2006.01) |
| ***E04B 2/74*** | (2006.01) |
| ***E04F 15/18*** | (2006.01) |

(52) U.S. Cl.

CPC ..... *E04B 2/828* (2013.01); *E04B 2/7416* (2013.01); *E04B 2/7457* (2013.01); *E04F 15/18* (2013.01)

(58) Field of Classification Search

CPC ..... E04F 15/18; E04B 2/7416; E04B 2/7457

(Continued)

(56) References Cited

U.S. PATENT DOCUMENTS 4,631,881 A * 12/1986 Charman ..... E04B 2/7425 160/135
5,065,559 A * 11/1991 Zegel ..... E04B 2/7425 160/135

(Continued)

OTHER PUBLICATIONS

International Search Report and Written Opinion for PCT/US2014/064856 dated Feb. 12, 2015.

(Continued)

*Primary Examiner* — Brian E Glessner
*Assistant Examiner* — Adam G Barlow
(74) *Attorney, Agent, or Firm* — Workman Nydegger

(57) ABSTRACT

Implementations of the present disclosure relate to systems, methods, and apparatus for connecting one or more wall modules to structural components of a building. At least one implementation includes connections that can allow the wall module to couple to a structural wall. For instance, the wall module can extend away from an end of the structural wall. In particular, the wall module can have a frame that connects to the structural wall on at least one side face and one or more panels that connect to the frame to at least partially conceal the structural wall and the frame from a first vantage point. Accordingly, the structural wall together with one or more wall modules can divide the floor space of a building into one or more individual spaces.

26 Claims, 10 Drawing Sheets

(58) Field of Classification Search
USPC ..... 52/481.1, 481.2, 506.03, 506.06, 506.08, 52/293.3, 656.4
See application file for complete search history.

(56) References Cited

U.S. PATENT DOCUMENTS

| | | | | | |
|---|---|---|---|---|---|
| 5,175,969 | A * | 1/1993 | Knauf | E04B 2/7422 | 160/135 |
| 5,341,615 | A * | 8/1994 | Hodges | E04B 2/7425 | 52/220.7 |
| 5,406,760 | A * | 4/1995 | Edwards | E04B 2/7416 | 160/351 |
| 5,638,650 | A * | 6/1997 | Edwards | E04B 2/7416 | 160/351 |
| 5,943,834 | A * | 8/1999 | Jeffers | E04B 2/7425 | 160/351 |
| 6,223,485 | B1 * | 5/2001 | Beck | E04B 2/7425 | 52/239 |
| 6,276,102 | B1 * | 8/2001 | Shipman | A47B 57/425 | 52/220.7 |
| 6,425,219 | B1 * | 7/2002 | Barmak | E04B 2/7425 | 52/238.1 |
| 6,851,226 | B2 * | 2/2005 | MacGregor | A47B 83/001 | 52/220.7 |
| 7,681,365 | B2 * | 3/2010 | Klein | E04B 2/7411 | 52/1 |
| 7,810,289 | B2 * | 10/2010 | Montgomery | E04F 13/081 | 52/235 |
| 8,024,901 | B2 | 9/2011 | Gosling | | |
| 2002/0108330 | A1 * | 8/2002 | Yu | E04B 2/7433 | 52/238.1 |
| 2002/0139060 | A1 * | 10/2002 | Contreras | E04B 1/762 | 52/101 |
| 2004/0020137 | A1 * | 2/2004 | Battey | E04B 2/7425 | 52/36.1 |
| 2004/0031224 | A1 | 2/2004 | Elderson | | |
| 2004/0035074 | A1 * | 2/2004 | Stanescu | E04B 2/7422 | 52/481.2 |
| 2004/0177573 | A1 * | 9/2004 | Newhouse | B25B 5/003 | 52/239 |
| 2006/0059806 | A1 * | 3/2006 | Gosling | E04B 2/7424 | 52/238.1 |
| 2009/0294613 | A1 * | 12/2009 | Cline | E04B 2/7416 | 248/221.11 |
| 2010/0066148 | A1 * | 3/2010 | Matthews | A01M 31/02 | 297/423.12 |
| 2010/0275548 | A1 | 12/2010 | Wright | | |
| 2011/0232218 | A1 * | 9/2011 | Hynes | E04G 11/10 | 52/319 |
| 2013/0025220 | A1 * | 1/2013 | Yu | E04B 2/7425 | 52/220.7 |
| 2013/0067839 | A1 * | 3/2013 | Zimmerman | E04B 1/26 | 52/293.3 |
| 2014/0220874 | A1 * | 8/2014 | Meyer | F24H 3/002 | 454/159 |

OTHER PUBLICATIONS

Zeiger. Henkel Headquarters. Architect. Dec. 2009. [retrieved on Jan. 14, 2015] Retrieved from the internet. <URL: http://www.architectmagazine.com/office-and-business/henkel-headquarters-scottsdale-arizonaaspx> entire document.

Supplementary Search Report for application No. 14843192.7 dated May 17, 2017.

* cited by examiner

MODULAR WRAP AROUND WALL

CROSS-REFERENCE TO RELATED APPLICATIONS

The present invention is a 35 U.S.C. § 371 U.S. National Stage of PCT Application No. PCT/US2014/064856 entitled MODULAR WRAP-AROUND WALL filed Nov. 10, 2014, which claims the benefit of priority to U.S. Provisional Application No. 61/906,656, entitled MODULAR WRAP-AROUND WALL, filed Nov. 20, 2013. The entire content of each of the aforementioned patent applications is incorporated herein by reference.

BACKGROUND OF THE INVENTION

1. The Field of the Invention

This disclosure relates to systems, methods, and apparatus for connecting one or more extension divider walls or wall modules to structural components of a building.

2. Background and Relevant Art

Commonly, builders or architects divide the interior space of residential and commercial buildings into smaller areas. For example, a builder can divide the floor plan in a commercial building into discrete working areas, such as reception areas, offices, conference rooms, etc. To divide the floor space, the builder typically installs divider walls, which define (and separate) the discrete working areas within the building. Such divider walls can be permanent, semi-permanent, or temporary. For instance, the builder or occupants of the building can disassemble and rearrange semi-permanent and/or temporary divider walls to reconfigure the working areas in the building.

In some instances, the building can include permanent or structural divider walls. For example, a concrete wall that may carry structural load also can at least partially divide or segment the interior space of the building into smaller, individual spaces. The builder or designer may choose to cover or conceal such structural wall for aesthetical reason as well as to accommodate various utility lines.

Moreover, the builder or designer can choose to add divider walls and wall segments to the divider formed by the structural wall, to further subdivide the interior space of the building. Such extension walls can have rigid connections with the structural divider wall. Accordingly, during a seismic event, the extension walls can move together with the structural wall and/or together with other structural portions of the building (e.g., floor and/or ceiling), which in some cases may damage the extension walls.

Accordingly, there are a number of disadvantages in connecting divider walls to structural components of a building that can be addressed.

BRIEF SUMMARY

Implementations of the present disclosure provide systems, methods, and apparatus for providing a divider wall by connecting one or more wall modules (i.e., extension divider walls) to a structural component of a building. Particularly, at least one implementation includes one or more connections or connection elements that can allow the extension divider wall to couple with a structural wall of a building. For instance, the extension divider wall can comprise a frame configured to be connected to the structural wall. The frame can include one or more supports (e.g., vertical and horizontal supports) and/or connection elements. In some embodiments, the extension divider wall can extend away from an end of the structural wall. Accordingly, the structural wall, together with one or more extension divider walls, can form a divider wall installation and can divide the floor space of a building into one or more individual spaces.

Additional features and advantages of exemplary implementations of the disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
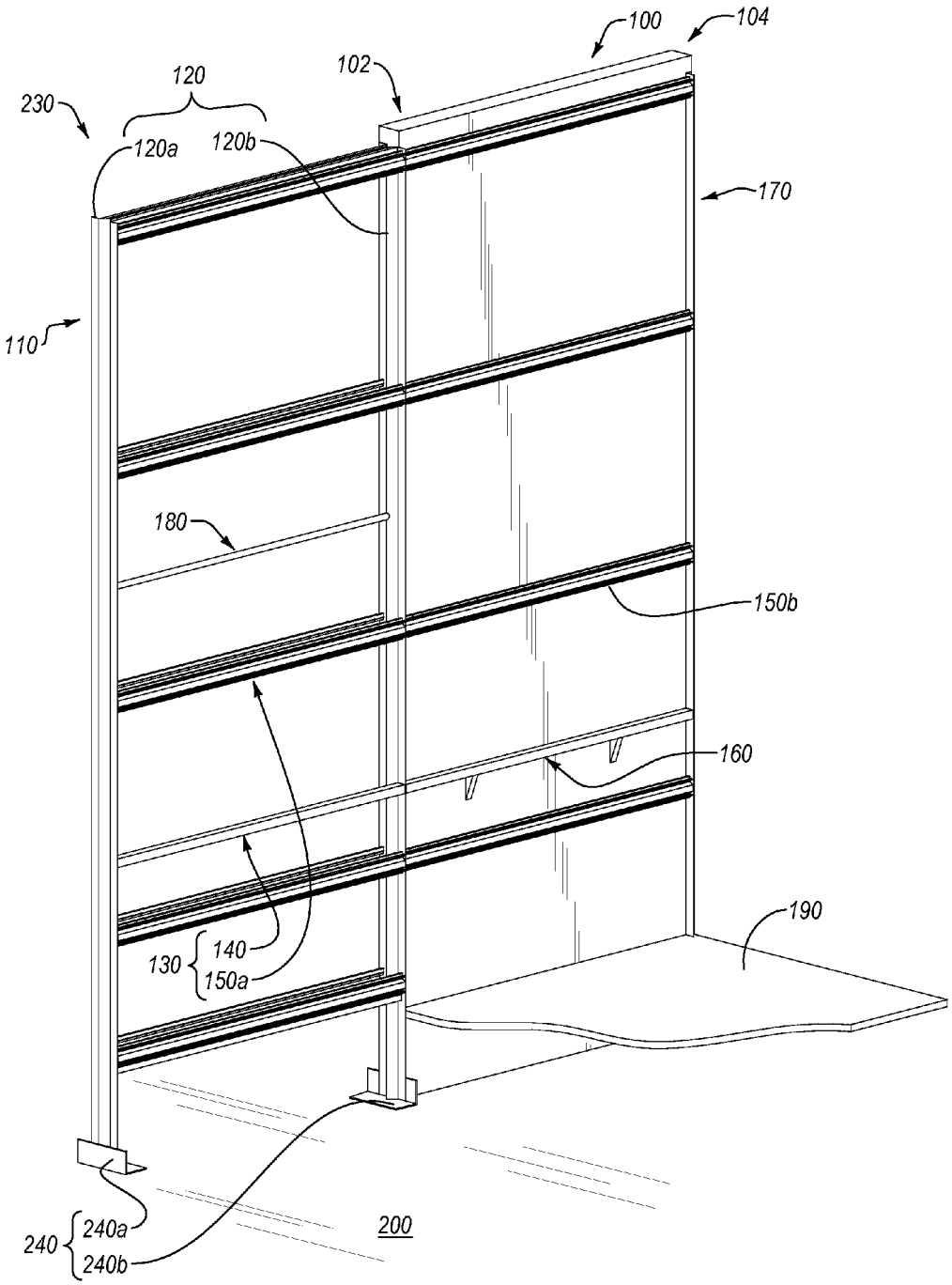
FIG. 1 illustrates a perspective view of a frame of a divider wall installation in accordance with an implementation of the present disclosure.

Before describing the present disclosure in detail, it is to be understood that this disclosure is not limited to parameters of the particularly exemplified products, processes, kits, and/or methods, which may, of course, vary. It is also to be understood that the terminology used herein is only for the purpose of describing particular embodiments of the present disclosure, and is not intended to limit the scope of the disclosure in any manner.

Additionally, the terms "including," "having," "involving," "containing," "characterized by," and variants thereof (e.g., "includes," "has," and "involves," "contains," etc.) as used herein, including the claims, shall be inclusive and/or open ended, shall have the same meaning as the word "comprising" and variants thereof (e.g., "comprise" and "comprises"), and does not exclude additional, unrecited elements or method steps, illustratively.

It will be noted that, as used in this specification and the appended claims, the singular forms "a," "an" and "the" include plural referents unless the content clearly dictates otherwise. Thus, for example, reference to a "vertical support" includes one, two, or more vertical supports.

As used in the specification and appended claims, directional terms, such as "top," "bottom," "left," "right," "up," "down," "upper," "lower," "proximal," "distal," and the like are used herein solely to indicate relative directions and are not otherwise intended to limit the scope of the disclosure or claims. Similarly, terms such a "horizontal," "vertical," "lateral," and the like are used herein solely to indicate relative orientation and are not otherwise intended to limit the scope of the disclosure or claims.

Where possible, like numbering of elements have been used in various figures. Furthermore, multiple instances of an element and or sub-elements of a parent element may each include separate letters appended to the element number. For example two instances of a particular element "120" may be labeled as "120*a*" and "120*b*". In that case, the element label may be used without an appended letter (e.g., "120") to generally refer to instances of the element or any one of the elements. Element labels including an appended letter (e.g., "120*a*") can be used to refer to a specific instance of the element or to distinguish or draw attention to multiple uses of the element. Furthermore, an element label with an appended letter can be used to designate an alternative design, structure, function, implementation, and/or embodiment of an element or feature without an appended letter. Likewise, an element label with an appended letter can be used to indicate a sub-element of a parent element.

Various aspects of the present devices and systems may be illustrated by describing components that are coupled, attached, and/or joined together. As used herein, the terms "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present. Furthermore, as used herein, the terms "connection," "connected," and the like do not necessarily imply direct contact between the two or more elements.

Various aspects of the present disclosure may be illustrated with reference to one or more exemplary embodiments. As used herein, the term "exemplary" means "serving as an example, instance, or illustration," and should not necessarily be construed as preferred or advantageous over other embodiments disclosed herein.

It will also be appreciated that where a range a values (e.g., less than, greater than, at least, or up to a certain value, or between two recited values) is disclosed or recited, any specific value or range of values falling within the disclosed range of values is likewise disclosed and contemplated herein.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only example materials and methods are described herein.

Implementations of the present disclosure provide systems, methods, and apparatus for providing a divider wall by connecting one or more wall modules (i.e., extension divider walls) to a structural component of a building. Particularly, at least one implementation includes one or more connections or connection elements that can allow the extension divider wall to couple with a structural wall of a building. For instance, the extension divider wall can comprise a frame configured to be connected to the structural wall. The frame can include one or more supports (e.g., vertical and horizontal supports) and/or connection elements. In some embodiments, the extension divider wall can extend away from an end of the structural wall. Accordingly, the structural wall, together with one or more extension divider walls, can form a divider wall installation and can divide the floor space of a building into one or more individual spaces.

In accordance with at least one implementation, a divider wall installation can include a wall module connected to a structural wall. In at least one implementation, the wall module can include a frame. The frame can include one or more vertical supports and one or more horizontal supports. One will appreciate that reference to "horizontal" and "vertical" is illustrative only and that alternative orientations are also contemplated herein. In at least one implementation, one or more vertical supports can be coupled to the structural wall to connect the frame thereto. In at least one implementation, the one or more horizontal supports can be coupled to the structural wall to connect the frame thereto. For instance, the frame can include one or more cross-members coupled to the structural wall. Specifically, the cross-members can connect to one or more major sides or faces of the structural wall (e.g., along the length thereof) and can connect to one or more vertical supports (e.g., at an end thereof).

In some implementations, one or more horizontal supports can extend between and/or connect opposing vertical supports (e.g., providing or enhancing structural rigidity to the frame). For instance, the frame can include one or more horizontal connectors disposed between two vertical supports of the frame. In some implementations, the horizontal supports can include one or more torsion bars connected to the vertical supports. The torsion bar(s) can increase rigidity of the frame and provide additional structural support thereto. Particularly, the torsion bar can restrain one vertical support from rotating or twisting relative to another vertical support, and vice versa. Additionally or alternatively, the one or more horizontal supports can include one or more stringers configured to receive one or more panels such that the one or more panels are secured to the frame.

In some implementations, the extension divider wall can include one or more panels secured to the frame. The panel(s) can conceal at least a portion of the frame (including one or more elements thereof) as well as any number of internal elements or components (e.g., utility lines, cables, plumbing, etc.) that may be secured to the frame or disposed within the frame (e.g., within the space formed between opposing panels) from at least one vantage point. For instance, in at least one implementation, the one or more panels can conceal at least a portion of the one or more horizontal supports and/or vertical supports from a front and/or side facing view. Similarly, the one or more panels can conceal at least a portion of the structural wall (e.g., from a front and/or side facing view). In certain implementations, the panel(s) can span across one or more sides of the frame and/or across one or more sides of the structural wall (e.g., including any gap therebetween). In one or more implementations, the panel(s) can also conceal at least a portion of the end of the frame and/or structural wall.

In one or more implementations, the panel(s) can conceal at least a portion of opposing sides of the frame and/or structural wall. For instance, a plurality of panels can be secured to the frame on both sides of the structural wall. Similarly, a plurality of panels can be secured to the frame on both sides of the frame. In at least one implementation, a plurality of panels can be secured to the frame on both sides of the structural wall and the frame. One will appreciate that an installer may have need to cover one or more sides of the frame and/or structural wall depending on the configuration of the space in the building. Accordingly, the extension divider wall can be configured to accommodate a variety of design schemes.

Thus, an installer can secure a single or multiple panels to the frame in a manner that conceals or covers at least a portion of the divider wall installation. For instance, an installer can secure a single or multiple panels to the frame in a manner that conceals or covers one side, face, and/or end of the extension divider wall and/or the structural wall. Alternatively, the panels can conceal or cover multiple sides (illustratively, a first major side or face, a second major side or face, and/or an end) of the extension divider wall and/or the structural wall. Furthermore, in some instances, the panel(s) can be connected to the structural wall.

In some implementations, one or more vertical brackets can connect to the structural wall (e.g., to the major side and/or to the opposing major sides of the structural wall). In at least one implementation, the one or more vertical brackets can provide a vertical support on the structural wall opposite the frame. In one or more implementations, a vertical support can be connected to the structural wall on a first end thereof (e.g., the end from which the wall module extends) and a vertical bracket can be connected to the structural wall at a distance from the first end (e.g., on a second end thereof, opposite the first end). In some implementations, the vertical support can be separated from the first end of the structural wall by a distance. One or more horizontal supports can connect and/or extend between the vertical brackets and one or more vertical supports of the frame. Accordingly, the frame of the extension divider wall can be coupled to the structural wall by means of the one or more vertical brackets and/or vertical supports connected thereto.

In some implementations, the frame can be secured to a floor of the building with one or more floor brackets. As used herein, a floor can include a structural support surface or structural floor, including a sub-floor or ground level, as well as an elevated or suspended floor. Accordingly, in some embodiments, the frame can rest upon and/or be connected to a structural floor and/or a suspended floor of the building.

Various implementations of the present disclosure involve connections. For instance, components, elements, members, and/or features described herein can be connected, coupled, and/or attached to one another by various means and/or mechanisms. In at least one implementation, one or more fasteners can be used to accomplish and/or effectuate such connections. Such fasteners are known in the art and can include such means as screws, bolts, nuts, washers, lock-washers, nails, rivets, clamps, clasps, clips, grips, straps, ties, latches, brackets, interlocking members, adhesives, and any other suitable fastener.

Additional or alternative implementations can include flexible connections that can allow at least a portion of the extension divider wall to move relative to the building's structural components (e.g., relative to the structural divider wall, ceiling, floor, etc.). Consequently, in the event that the structural components of the building move relative to each other, such as during a seismic event, the flexible connections can minimize, reduce, or eliminate damage to the extension divider walls or the structures to which the extension walls are secured.

Also, the extension divider walls can include modular walls and wall modules that can removably connect to the structural divider wall, as described below in further detail. Likewise, the panels can removably connect to the divider wall (i.e., to the portion of the divider wall formed by the structural wall and/or to the portion of the divider wall formed by the modular wall). Moreover, in at least one implementation, a panel can span across at least a portion of the structural wall and a across at least a portion of the divider wall (e.g., with no gap therebetween).

Turning now to the figures, FIGS. 1-7 illustrate an exemplary divider wall installation 230. More specifically, as illustrated in FIG. 1, the divider wall installation 230 can include a structural wall 100 and a frame 110 of a wall module 220 (or extension divider wall) (see e.g., FIG. 2). An installer can connect or couple the frame 110 of the wall module 220 to the structural wall 100 with any number of suitable connections, which may be rigid or flexible, and which may vary from one implementation to another. The frame 110 can include one or more vertical supports 120 (e.g., vertical supports 120*a*, 120*b*) and one or more horizontal supports 130. For example, horizontal supports 130 can include horizontal connectors 140 that can connect opposing vertical supports 120 and can provide structural rigidity to the frame 110. Additionally or alternatively, the horizontal supports 130 can include stringers 150*a*, which can secure one or more panels 210 to the frame 110 of wall module 220 (see e.g., FIG. 2).

In some implementations, as noted above, the frame 110 can connect to the structural wall 100. For instance, vertical support 120*b* can be connected to the first end 102 of structural wall 100. In an alternative implementation, vertical support 120*b* can be separated from the first end 102 of structural wall 100 by a distance. One or more cross-members 160 can connect or be fastened to the structural wall 100 as well as to one or more of the vertical supports 120 (e.g. to the vertical support 120*b*), thereby coupling the frame 110 to the structural wall 100. Specifically, the cross-members 160 can connect to one or more major sides or faces of the structural wall 100 along the length thereof and can connect to the vertical support 120*b* at an end thereof.

In one example, the cross-members 160 can have an approximately horizontal orientation. It should be appreciated, however, that the installer can connect the cross-members 160 to the structural wall 100 in any number of suitable positions and/or orientations, which can vary from one implementation to another. Moreover, the installer can secure multiple cross-members 160 on a single side or on opposing sides of the structural wall 100, and the cross-members 160 can connect to one or more of the vertical supports 120, such as to the vertical support 120*b*.

In one exemplary implementation, one or more vertical brackets, such as a bracket 170, can connect to the structural wall 100 (e.g., to the major side and/or to the opposing major sides of the structural wall 100). Consequently, the installer can secure one or more stringers 150*b* to the vertical bracket 170 at a first end of the stringer 150*b* and to the vertical support 120*b* at a second, opposing end of the stringer 150*b*. As such, the stringers 150*b* also can couple the frame 110 to the structural wall 100. It should be appreciated that the stringers 150*b* can be similar to or the same as the stringers 150*a*.

Figure 3:
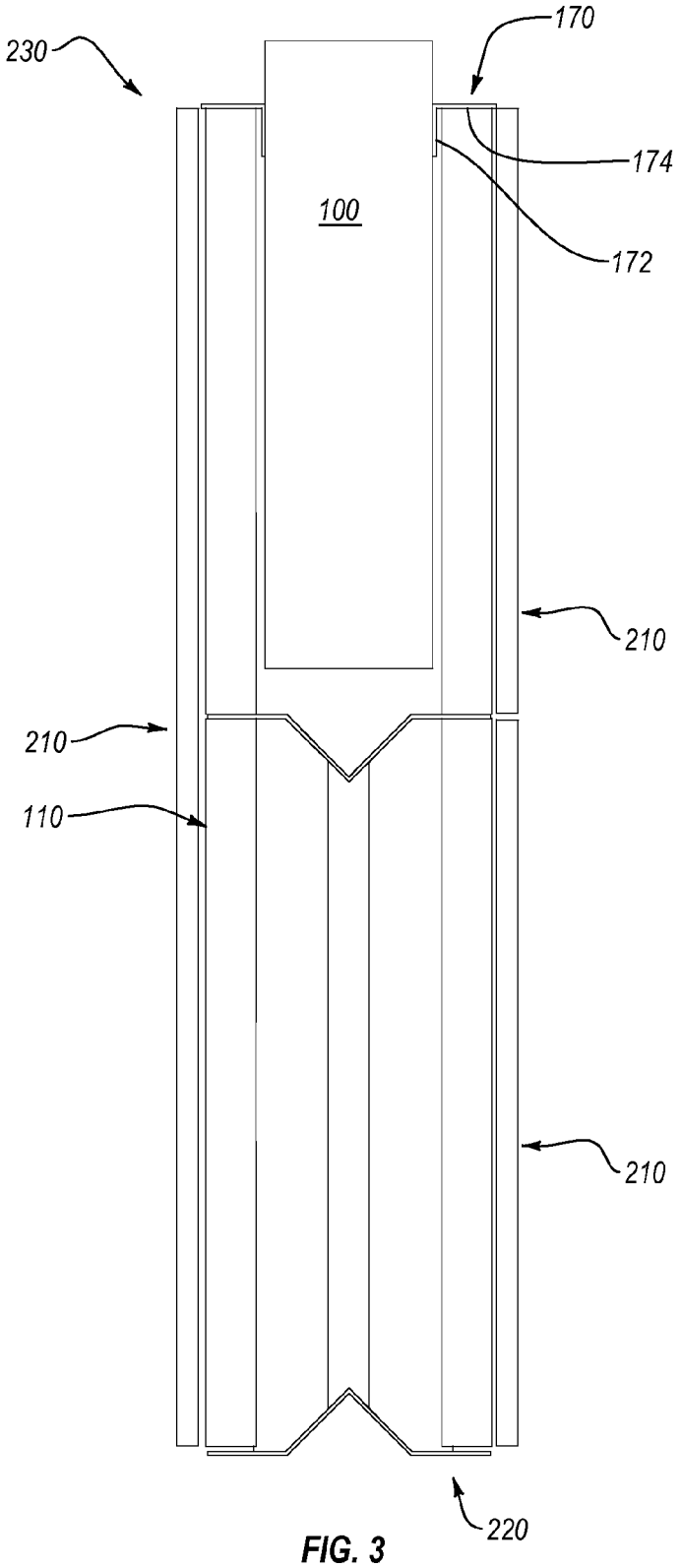
FIG. 3 illustrates a top view of the divider wall installation of FIG. 2.
Figure 4:
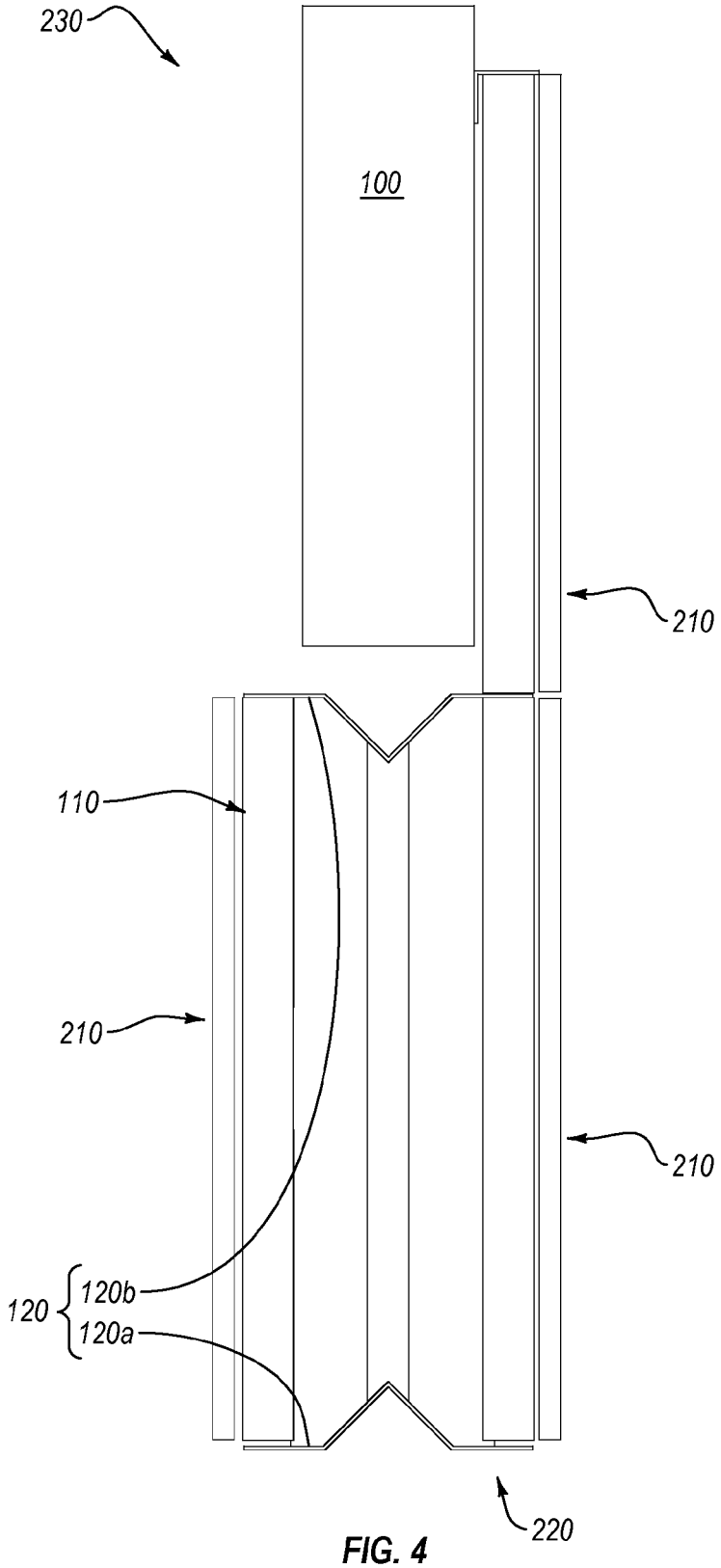
FIG. 4 illustrates a top view of another divider wall installation in accordance with an implementation of the present disclosure.
Figure 4A:
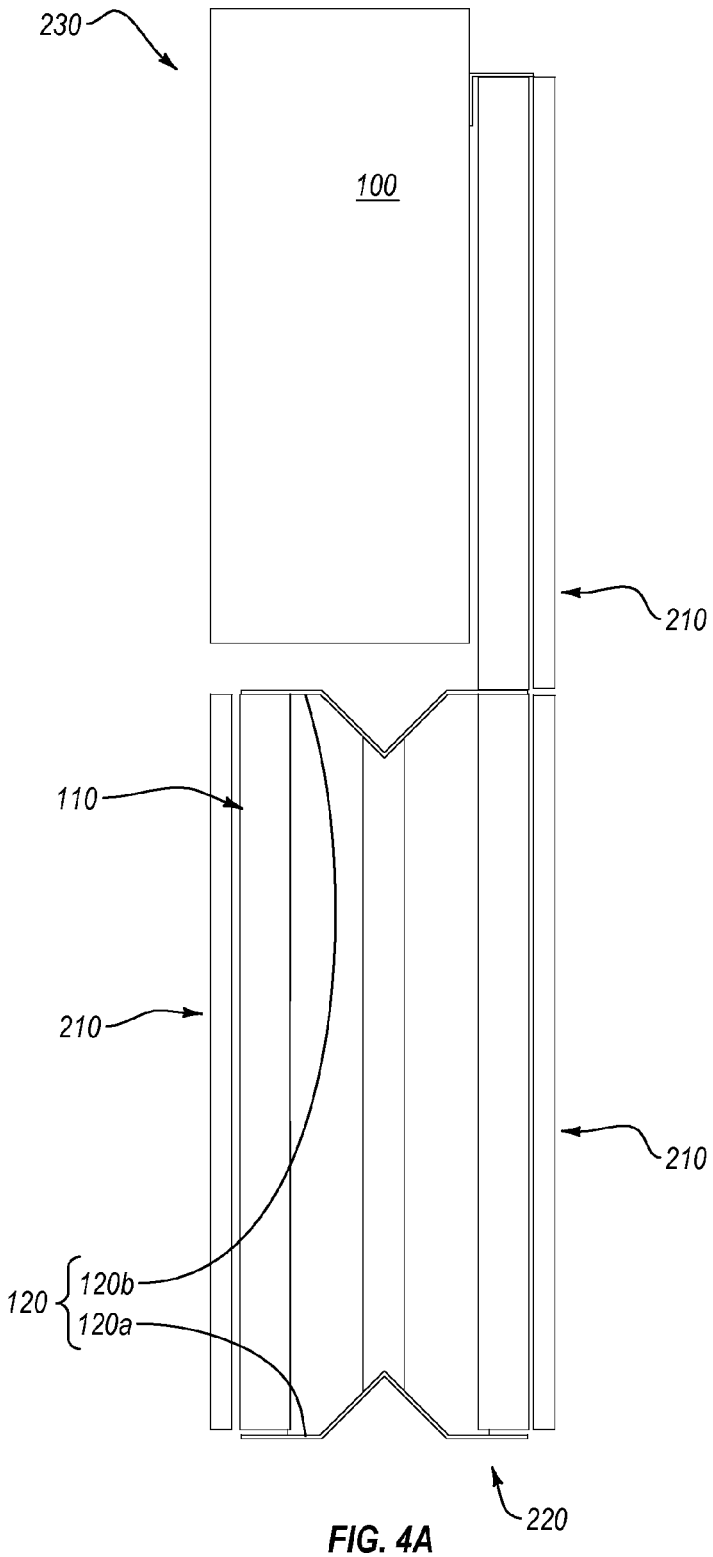
FIG. 4A illustrates a top view of another divider wall installation in accordance with an implementation of the present disclosure.
Figure 4B:
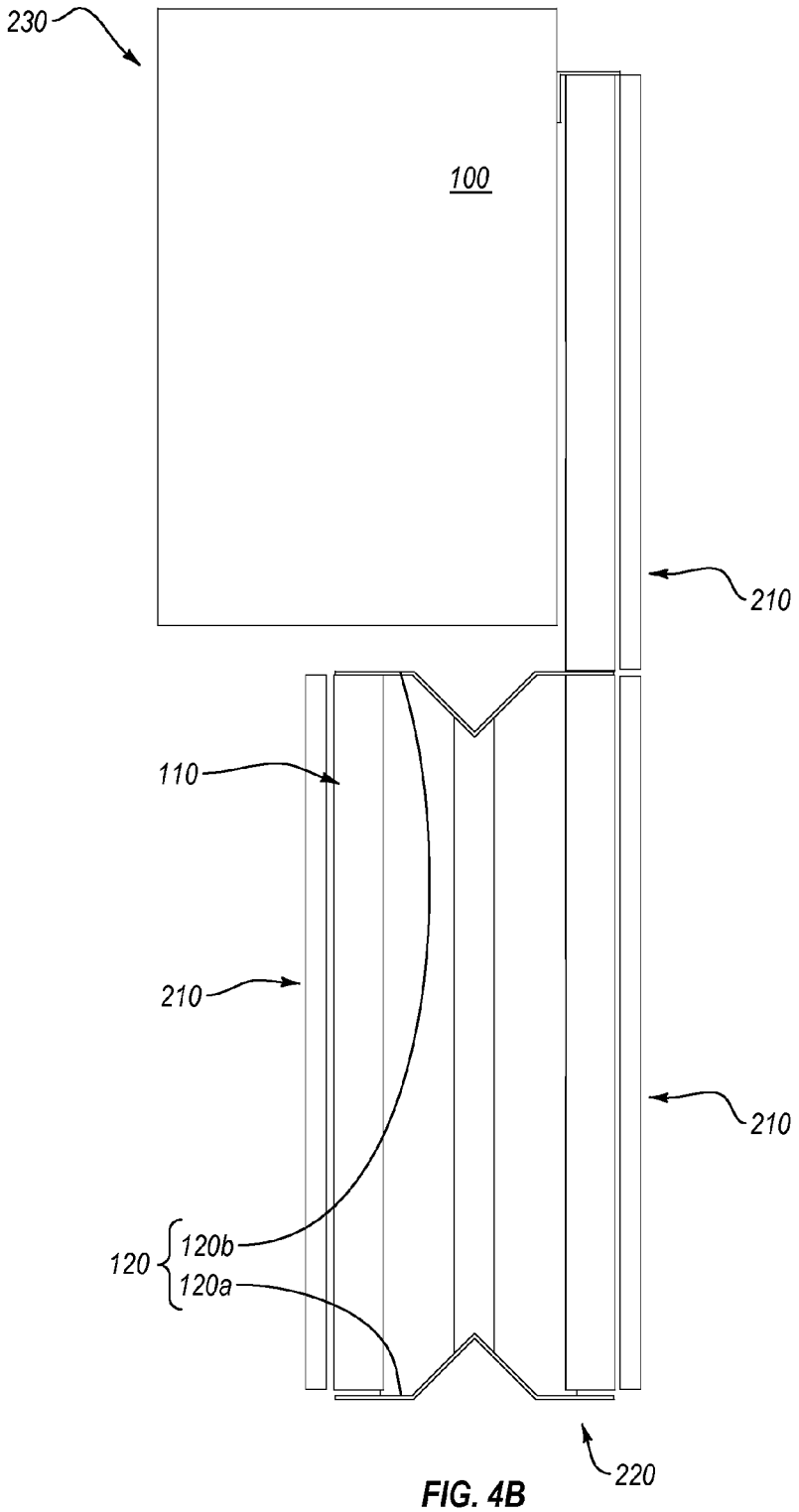
FIG. 4B illustrates a top view of another divider wall installation in accordance with an implementation of the present disclosure.
Figure 4C:
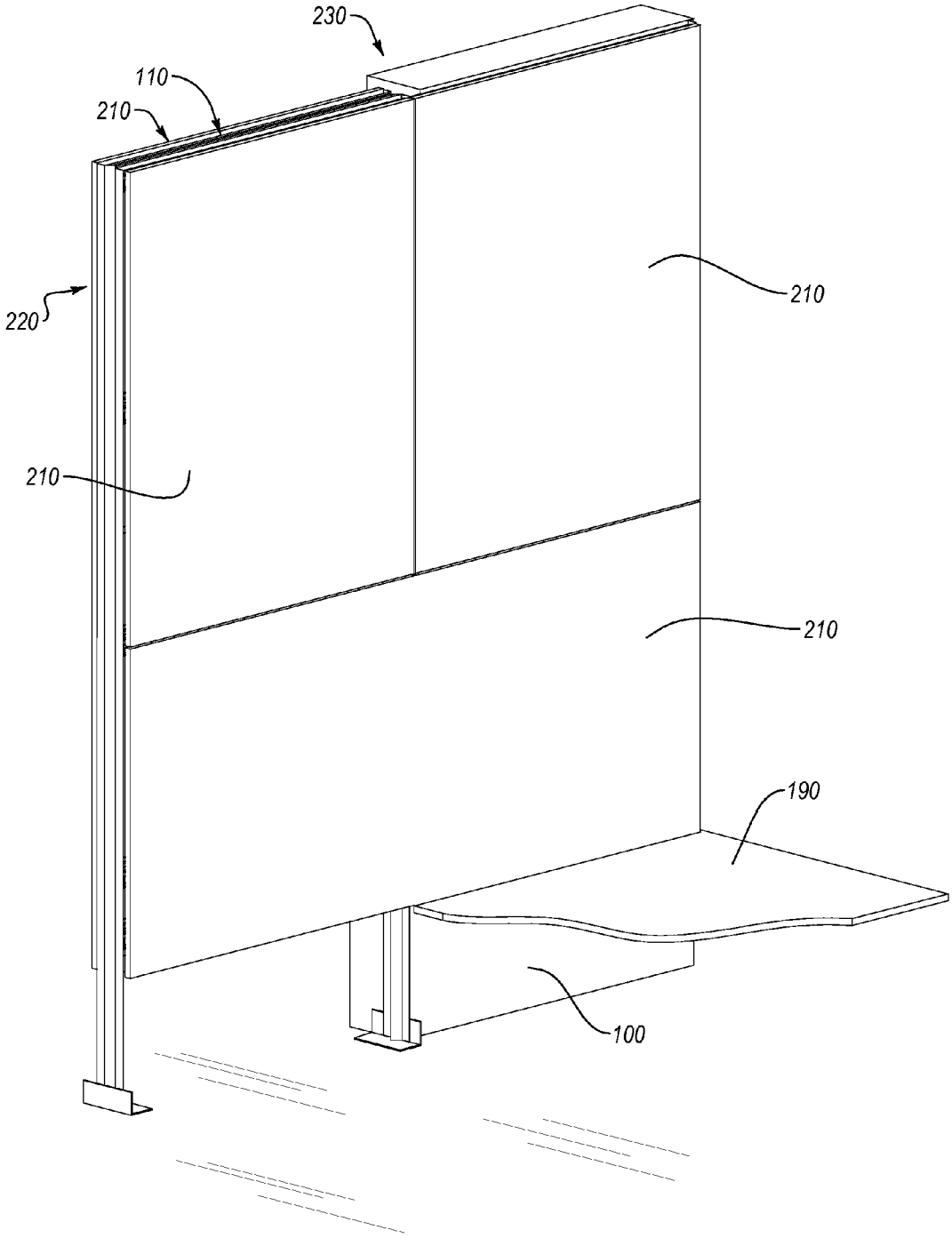
FIG. 4C illustrates a perspective view of the divider wall installation of FIG. 4B.

The vertical bracket 170 can have any number of suitable configurations that can allow the installer to secure one or more stringers 150*b* thereto. Moreover, the vertical bracket 170 can connect to one or more of the face(s) and/or to any other side of the structural wall 100, as may be suitable for a particular installation. In one implementation, as illustrated in FIG. 3, the vertical bracket 170 can comprise an L-shaped extrusion that includes a base 172 and a vertical wall 174 connected to or integrated with the base. Particularly, the installer can connect or otherwise secure the base 172 of the vertical bracket 170 to the face of the structural wall 100.

Furthermore, the installer can connect or otherwise secure the stringers 150*b* to the vertical wall 174 of the vertical bracket 170. Accordingly, the stringers 150*b* can connect the frame 110 to the structural wall 100 through the connection of one or more stringers 150*b* to the vertical bracket 170 and through the connection of the vertical bracket 170 to the structural wall 100. In one or more implementations, however, the stringers 150*b* can be otherwise integrated with the vertical bracket 170 or can otherwise connect directly to the structural wall 100.

Similarly, the stringers 150*a* can connect to the vertical supports 120. For instance, the stringers 150*a* can connect to the vertical support 120*a* at one or more similar or the same locations as the stringers 150*b*. In other words, the stringers 150*a* can align with the stringers 150*b*, such that the stringers 150*a* are positioned approximately at the same heights as the stringers 150*b* (from the same reference point) and in approximately the same orientation (i.e., parallel to each other). Accordingly, connectors positioned on the respective stringers 150*a*, 150*b* can connect a single panel 210 that can span from the frame 110 onto the structural wall 100. In other implementations, the stringers 150*a*, 150*b* can be positioned at different heights.

In additional or alternative implementations, the stringers 150*a*, 150*b* can connect multiple panels 210 (see e.g., FIG. 2) on each of the frame 110 and/or on the structural wall 100. In any event, the stringers 150*a*, 150*b*, can connect any suitable number of panels 210 in a manner that conceals at least a portion of the frame 110 and/or the structural wall 100. Furthermore, as mentioned above, the panels 210 connected to the frame 110 and/or to the structural wall 100 can provide the frame 110 with an appearance that is substantially indistinguishable from the appearance of the structural wall 100, and vice versa.

In some implementations, the horizontal supports 130 also can include one or more torsion bars, such as a torsion bar 180 connected to the vertical supports 120*a*, 120*b*. The torsion bar 180 can increase rigidity of the frame 110 and provide additional structural support thereto. Particularly, the torsion bar 180 can restrain the vertical support 120*a* from rotating or twisting relative to vertical support 120*b* and vice versa.

In some instances, the building may include a suspended floor, which can be set above a structural floor. For instance, one example can have a suspended floor 190 positioned at a distance above a structural floor 200. The structural floor 200 can be a concrete floor or another subfloor of a building. Furthermore, implementations of the present disclosure can include one or more wall modules 220 and/or frames 110 that can be set on the structural floor 200 and/or on the suspended floor 190. For instance, wall module 220 (or frame 110 thereof) can be set or secured to structural floor 200 by means of one or more floor brackets 240, such as floor bracket 240*a* secured to vertical support 120*a* of frame 110 and/or floor bracket 240*b* secured to vertical support 120*b* of frame 110.

Figure 2:
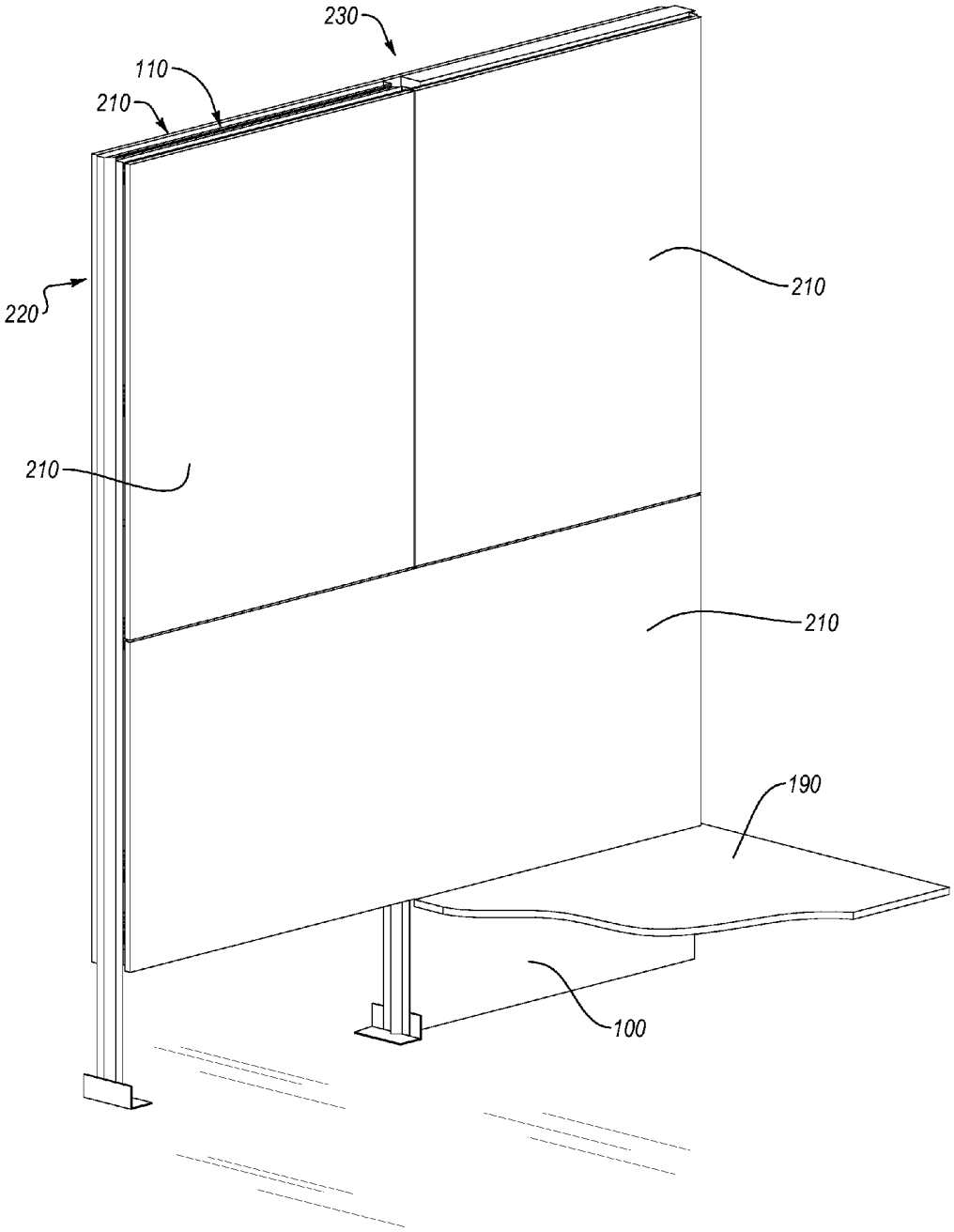
FIG. 2 illustrates a perspective view of the divider wall installation of FIG. 1 with attached panels in accordance with an implementation of the present disclosure.

As illustrated in FIGS. 1 and 2, the structural wall 100 can extend down to (or up from) the structural floor 200. Thus, in some instances, the installer can position the frame 110 on the structural floor 200 and can align and/or level the frame 110 relative to the structural wall 100 in a manner suitable for forming a single or uniform divider wall 230. Moreover, the vertical supports 120*a*, 120*b* can be positioned on the structural floor 200 and can include adjustment members (not shown), which can allow the installer to position and level the frame 110 relative to the structural floor 200 and to the structural wall 100. In other words, the adjustment members can allow the installer to adjust positions of the vertical supports 120*a*, 120*b* relative to the structural floor 200, thereby positioning and orienting the frame 110 relative to the structural wall 100.

It should be appreciated that in additional or alternative implementations the installer can position the frame 110 on the suspended floor 190 in a manner that forms a single divider wall installation 230 together with the structural wall 100. In other words, in at least one implementation, the panels 210 connected to the structural wall 100 and to the frame 110 can abut the suspended floor 190 and span upward on the frame 110 and the structural wall 100 (e.g., to the top(s) thereof). Alternatively or additionally, the panels can extend below the suspended floor 190 along the structural wall 100 and/or along the frame 110. In any event, the wall module 220 that includes the frame 110 and the structural wall 100 together can form a single or substantially uniform divider wall 230 that can at least partially define an individual space in the building.

As described above, one or more panels can connect to the frame 110 and/or to the structural wall 100. Moreover, the panels can span across one or more sides of the frame 110 and/or across one or more sides of the structural wall 100 as well as any gap therebetween. FIGS. 2 and 3 illustrate one example of panels 210 connected to the structural wall 100 and to the frame 110. Connecting the panels 210 to the frame 110 can form a wall module 220 that can be separate from the structural wall 100 or may share one or more panels 210 therewith. More specifically, the panels 210 can span over a gap or a separation (if any) between the frame 110 and the structural wall 100. In additional or alternative implementations, the panels 210 can be confined to the respective structural wall 100 and frame 110.

Furthermore, in at least one implementation, the panels 210 can at least partially conceal or at least partially cover at least a portion of the frame 110 and/or structural wall 100. For instance, a first panel 210 may span at least a portion of a face or other portion of the frame 110 and at least a portion of a face or other portion of the structural wall 100 such that an onlooker may not distinguish the structural wall 100 from the wall module 220 (e.g., a single, large, continuous panel that spans and/or covers a portion or substantially all of the viewable surface of a major side or face of the structural wall 100 and the frame 110; from the top thereof to the bottom thereof and/or from a first side thereof to an opposite side thereof). Alternatively, a panel 210 may otherwise span at least a portion of a face and/or surface portion, or other portion of the frame 110 and the structural wall 100 (e.g., a single, large, continuous panel that spans and/or covers substantially all of a portion (for example, a top portion or a bottom portion) of the viewable surface of a major side or face of the structural wall 100 and the frame 110).

Moreover, a panel 210 may span at least a portion of a face or other portion of the frame 110 and/or the structural wall 100 such that an onlooker can distinguish the structural wall 100 from the wall module 220 (e.g., a panel that spans and/or covers a surface of a major side or face of the structural wall 100 or the frame 110, but does not span both structures). For instance, a panel 210 may at least partially conceal or cover a top portion, a bottom portion, and/or substantially all of the viewable surface (e.g. floor-to-ceiling) of a major side or face of the structural wall 100 or the frame 110). In such a configuration, the structural wall 100 and the wall module 220 may appear to certain onlookers to comprise a plurality of wall modules 220 of an assembled modular wall.

In some implementations, the panel(s) 210 can be configured to appear as an extension of a structural wall 100 on one or more sides or faces of the structural wall 100. In addition (or in the alternative), the panel(s) 210 can be configured to make the structural wall 100 (or a portion thereof) indistinguishable from the wall module 220, frame 110, or a portion thereof. For example, the frame 110 of the wall module 220 can be connected to a first side of the structural wall 100 (see e.g., FIG. 1) and covered with a large, continuous panel 210 such that an onlooker may not distinguish the first side of the structural wall 100 from the wall module 220 or frame 110. Optionally, one or more additional panels 210 may be connected to the frame 110 adjacent to a second or opposing side of the structural wall 100 such that an onlooker can distinguish the second side of the structural wall 100 from the wall module 220, frame 110, or the panel(s) thereof.

In any case, the panels 210 can envelop or wrap around the frame 110 and structural wall 100, such as to conceal the structural wall 100 and the frame 110 from viewers. Accordingly, the builder or designer can convert or repurpose the structural wall 100, which may be otherwise aesthetically unappealing, as a divider wall that can include any number of decorative and/or structural panels 210, which can enhance the overall aesthetic of the wall. Furthermore, as noted above, by connecting the panels 210 and/or the wall module 220 to the structural wall 100, the installer can utilize the structural wall 100 as a portion of a divider wall. Furthermore, connection between the structural wall 100 and the wall module 220 can be seamless, such that an onlooker may not distinguish the structural wall 100 from the wall module 220 (e.g., after an installer connects the panels 210 to the frame 110 and/or to the structural wall 100, as described below).

In an alternative implementation, the wall module 220 can be configured as an extension of the structural wall 100 on one or more sides or faces of the structural wall 100. For example, the installer can connect or couple the frame 110 of the wall module 220 to one or more sides of the structural wall 100 such that an onlooker can distinguish the structural wall 100 from the wall module 220 (e.g., after an installer connects the panels to the frame 110 so as to cover the frame 110 but not the structural wall 100, as described below). Thus, in at least one implementation, the structural wall 100 and the wall module 220 may appear to certain onlookers to comprise a plurality of wall modules 220 of an assembled modular wall.

In some implementations, one or more sides of the frame 110 and/or structural wall 100 (or respective portion(s) thereof) can be covered and/or concealed by one or more panels 210. For instance, as illustrated in FIGS. 4-7, one or more panels can cover and/or conceal a first side of the frame 110 and/or structural wall 100 but not a second side of the frame 110 and/or structural wall 100. In at least one implementation, panels 210 can cover and/or conceal a first side of the structural wall 100 and opposing sides of the frame 110; but not a second side of the structural wall 100 (see e.g., FIGS. 4-4C). Thus, in certain implementations, an onlooker can view the second side of the structural wall 100 (and the panel 210 covering and/or concealing the frame 110) from a vantage point on the second side of the structural wall 100, while from the vantage point on the first side of the structural wall 100, an onlooker can view one or more panels covering the frame 110 and the first side of the structural wall 100. As illustrated in FIGS. 4, 4A, 4B, and 4C, the depth of structural wall 100 can be less than (FIG. 4), equal to (FIG. 4A), or greater than (FIG. 4B and FIG. 4C) the depth of wall module 220.

Figure 5:
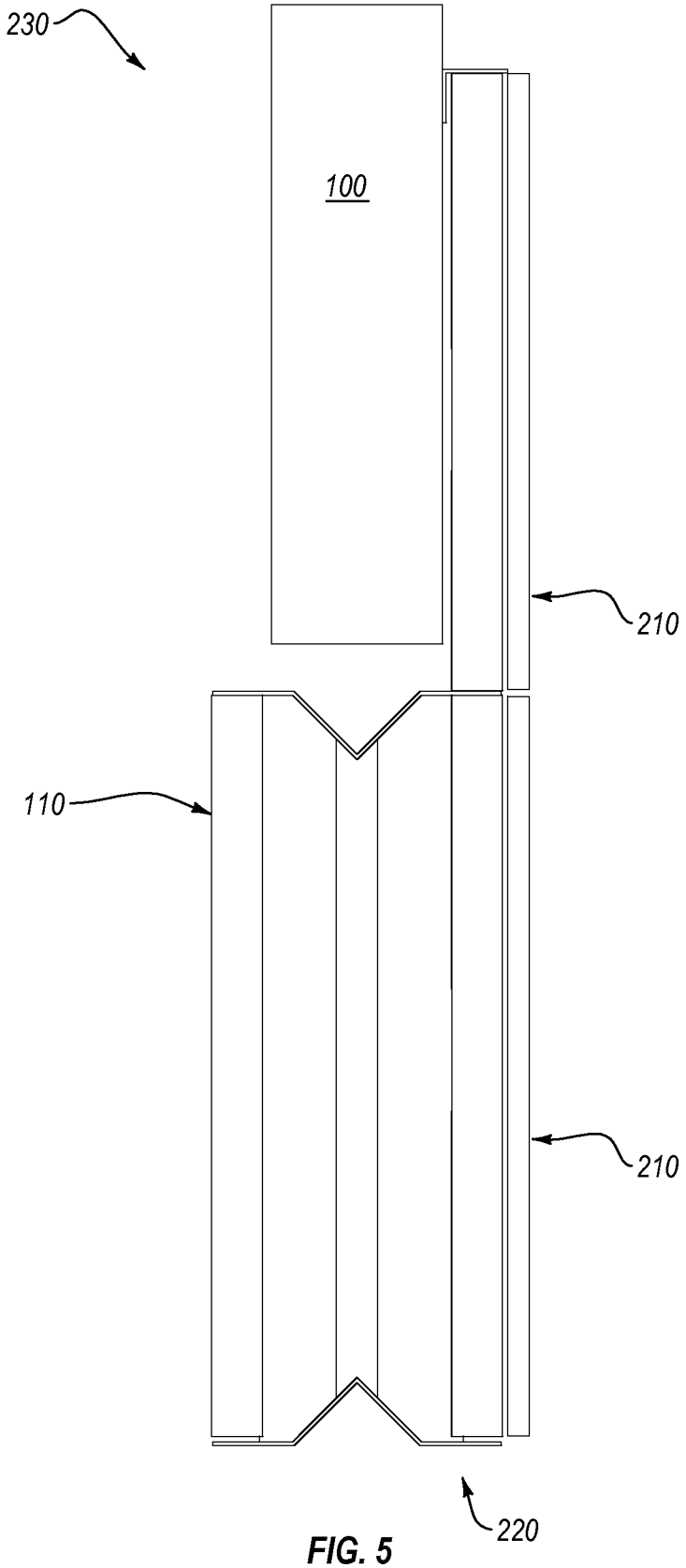
FIG. 5 illustrates a top view of another divider wall installation in accordance with an implementation of the present disclosure.
Figure 6:
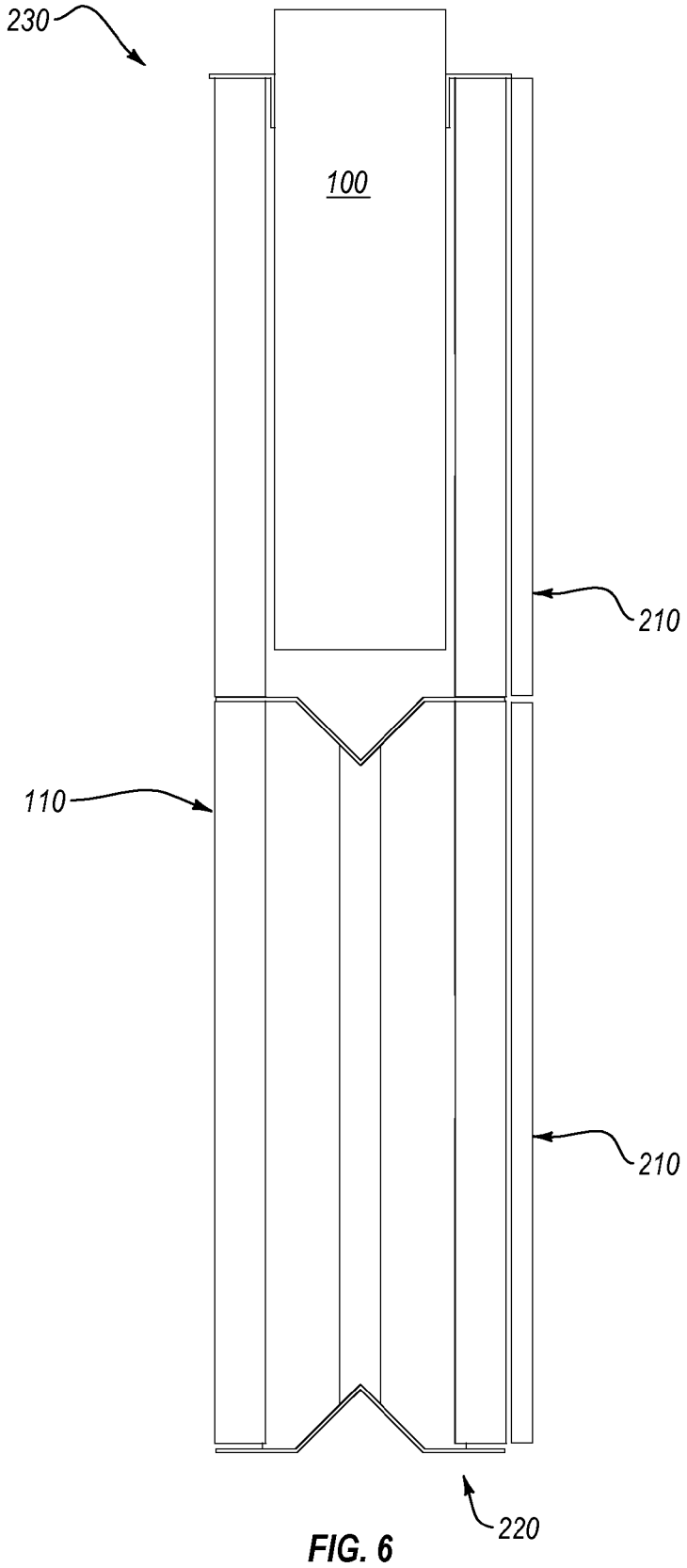
FIG. 6 illustrates a top view of another divider wall installation in accordance with an implementation of the present disclosure.
Figure 7:
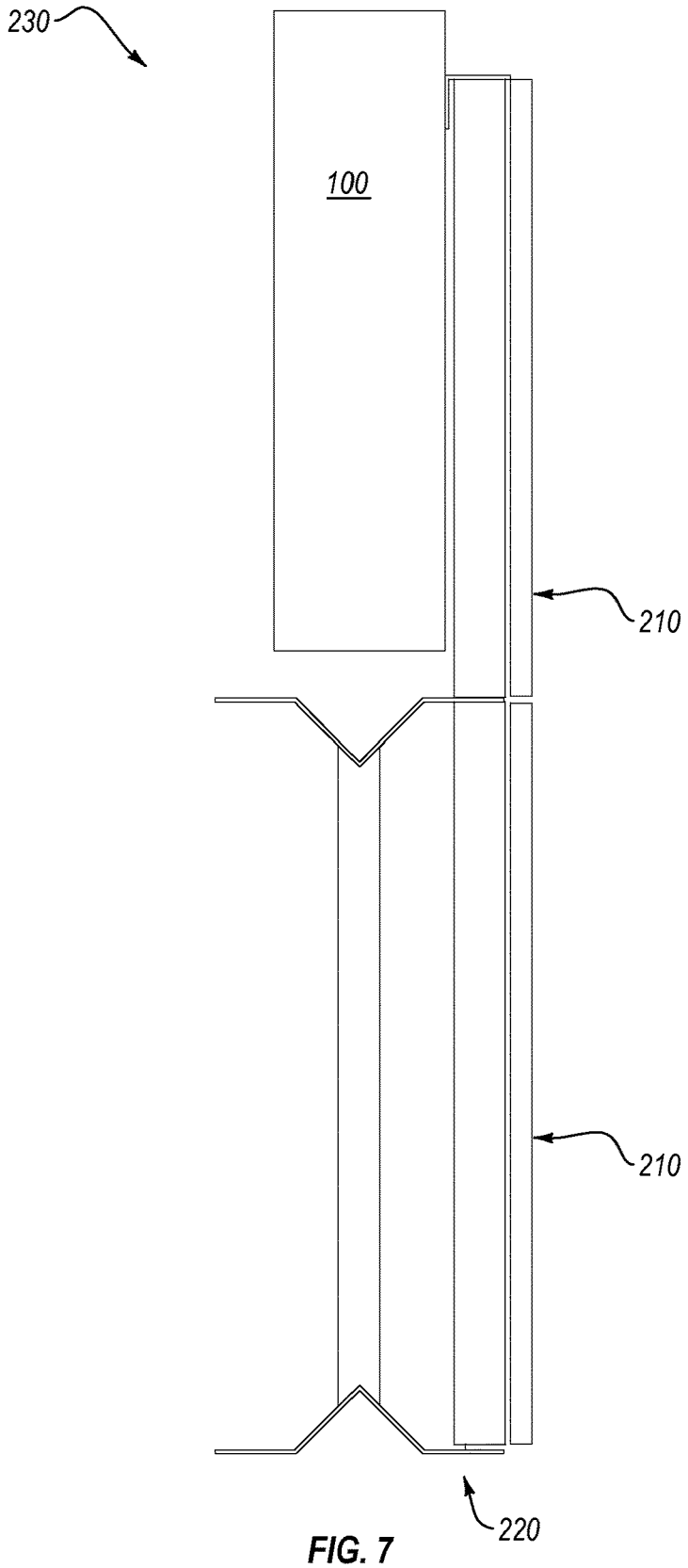
FIG. 7 illustrates a top view of another divider wall installation in accordance with an implementation of the present disclosure.

Similarly, panels 210 can cover and/or conceal a first side of the frame 110 and/or structural wall 100; but not a second side of the frame 110 and/or structural wall 100 (see e.g., FIGS. 5-6). In such a configuration, panels 210 can conceal only a first side of frame 110 and/or structural wall 100. Thus, in certain implementations, an onlooker can view a portion of the second side of the frame 110 from a vantage point on the second side of the structural wall 100, while from the vantage point on the first side of the structural wall 100, an onlooker can view one or more panels covering the frame 110 and the first side of the structural wall 100. In at least one implementation, the frame 110 can comprise one or more horizontal supports positioned on the second side of the frame 110 (see FIG. 5) or on the second side of frame 110 and structural wall 100 (see FIG. 6). In an alternative implementation, frame 110 can be void of horizontal supports on the second side of frame 110 and structural wall 100 (see FIG. 7).

Implementations of the present disclosure can also include assemblies and/or kits (e.g., configured to be assembled into a wall module). Accordingly, at least one implementation can include a plurality of modular wall or wall module elements and/or components configure to, operable to, adapted for, and/or capable of being assembled into a wall module 220. Those skilled in the art will appreciate that the combination of such modular wall or wall module elements and/or components into kits is often preceded by designing a specific divider wall, comprising a structural wall 100 and wall module 220. Accordingly, such kits can be designed and/or configured to be assembled into a wall module 100 configured to be connected to a structural wall 220.

While various aspects, implementations, and embodiments have been disclosed herein, other aspects, implementations, and embodiments are contemplated. The various aspects, implementations, and embodiments disclosed herein are for purposes of illustration and are not intended to be limiting. It is noted that products, processes, kits, and methods according to certain implementations of the present disclosure may include, incorporate, or otherwise comprise properties, features, components, members, and/or elements described in other implementations described and/or disclosed herein. Thus, reference to a specific feature in relation to one implementation should not be construed as being limited to applications only within said implementation. In addition, various implementations can be combined to form additional implementations without departing from the scope of the invention or this disclosure.

The present invention may be embodied in other specific forms without departing from its spirit or essential characteristics. The described implementations are to be considered in all respects only as illustrative and not restrictive. The scope of the invention is, therefore, indicated by the appended claims rather than by the foregoing description. While certain implementations and details have been included herein and in the attached invention disclosure for purposes of illustrating the invention, it will be apparent to those skilled in the art that various changes in the products, processes, kits, and methods disclosed herein may be made without departing from the scope of the invention, which is defined in the appended claims. All changes which come within the meaning and range of equivalency of the claims are to be embraced within their scope. Various modifications that fall within the scope of the appended claims will be apparent to one skilled in the art.

We claim:

1. A wall module configured to be connected to a structural wall, the structural wall having a first end and an opposing second end, the wall module comprising:

a frame configured to be connected to the structural wall;

wherein a first portion of the frame is configured to extend away from the first end of the structural wall in a direction opposite the second end of the structural wall, the first portion comprising a first vertical support and a second vertical support, the first vertical support positioned adjacent the first end of the structural wall, and the second vertical support positioned at least opposite the second end of the structural wall;

wherein a second portion of the frame spans a portion of at least one face of the structural wall between the first and second ends of the structural wall; the second portion of the frame being secured to the face of the structural wall at one or more points along the spanned portion; and one or more panels removably connectable to the frame such that the one or more panels at least partially cover the first and second portions of the frame and at least partially conceal the at least one face of the structural wall.

2. The wall module as recited in claim 1, wherein the frame comprises one or more horizontal supports connected to the first and second vertical supports.

3. The wall module as recited in claim 2, wherein at least one of the one or more horizontal supports comprises a stringer configured to have the one or more panels connected thereto.

4. The wall module as recited in claim 2, wherein the vertical supports further comprise a plurality of horizontal supports extended therebetween.

5. The wall module as recited in claim 2, wherein at least one of the vertical supports is connected to the structural wall.

6. The wall module as recited in claim 2, wherein at least one of the one or more horizontal supports is connected to the structural wall.

7. The wall module as recited in claim 2, wherein the frame comprises at least one torsion rod extending between first and second vertical supports.

8. The wall module as recited in claim 2, further comprising a vertical bracket configured to be connected to the structural wall and to at least one of the one or more horizontal supports.

9. The wall module as recited in claim 8, wherein the vertical bracket is configured to be connected to the second end of the structural wall.

10. The wall module as recited in claim 1, wherein at least one of the one or more panels is configured to be connected to the structural wall via the frame.

11. A divider wall for defining one or more individual spaces, comprising:

a wall module configured to be connected to a structural wall, the structural wall having a first end and an opposing second end, the wall module being configured to extend away from the first end of the structural wall in a direction opposite the second end of the structural wall, the wall module comprising:

one or more vertical supports, at least one of the one or more vertical supports being configured to be positioned adjacent to the first end of the structural wall;

one or more horizontal supports having a first end thereof configured to be connected to the at least one of the one or more vertical supports and having a second end thereof configured to be connected to the structural wall such that at least a portion of the one or more horizontal supports spans a portion of at least one face of the structural wall between the first and second ends of the structural wall, wherein the portion of the one or more horizontal supports is secured to the face of the structural wall at one or more points along the spanned portion; and one or more panels removably connectable to at least one of the one or more horizontal supports such that the one or more panels at least partially cover the portion of the at least one of the one or more horizontal supports and at least partially conceal the at least one face of the structural wall;

wherein the at least one of the one or more vertical supports comprises a first vertical support positioned adjacent to the first end of the structural wall, and the one or more vertical supports further comprises a second vertical support positioned distant from the structural wall in the direction at least partially opposite the second end of the structural wall.

12. The divider wall of claim 11, wherein the at least one of the one or more horizontal supports comprises a stringer configured to have the one or more panels removably connected thereto.

13. The divider wall of claim 11, wherein the one or more horizontal supports comprise two or more horizontal supports configured to be connected to the at least one of the one or more vertical supports and to the structural wall such that at least a portion of the two or more horizontal supports span a portion of opposing first and second side faces of the structural wall between the first and second ends of the structural wall.

14. The divider wall of claim 13, wherein the panels comprise two or more panels removably connectable to the two or more horizontal supports such that the two or more panels at least partially cover the portion of the two or more horizontal supports and at least partially conceal the opposing first and second side faces of the structural wall.

15. The divider wall of claim 11, further comprising at least one horizontal support configured to extend between the first and second vertical supports with a first end thereof coupled to the first vertical support and a second end thereof coupled to the second vertical support.

16. The divider wall of claim 15, wherein the at least one horizontal support configured to extend between the first and second vertical supports comprises at least one stringer configured to have at least one panel removably connected thereto.

17. The divider wall of claim 16, further comprising at least one panel removably connectable to the at least one stringer such that the at least one panel extends at least partially between the first and second vertical supports on at least a first side of the wall module.

18. The divider wall of claim 17, wherein the at least one panel comprises two or more panels removably connectable to opposing stringers configured to extend at least partially between the first and second vertical supports on opposing first and second sides of the wall module such that the two or more panels extend at least partially between the first and second vertical supports on the opposing first and second sides of the wall module.

19. The divider wall of claim 15, wherein the one or more panels removably connectable to the at least one of the one or more horizontal supports are removably connectable to the at least one horizontal support configured to extend between the first and second vertical supports.

20. The divider wall of claim 19, wherein the one or more panels are removably connectable to the at least one of the one or more horizontal supports and to the at least one horizontal support configured to extend between the first and second vertical supports on opposing first and second side faces of the divider wall and on opposing first and second sides of the wall module.

21. The divider wall of claim 11, further comprising a vertical bracket connected to the second end of the structural wall, wherein the second end of the one or more horizontal supports are configured to be connected to the structural wall by means of the vertical bracket.

22. The divider wall of claim 11, wherein at least a portion of the wall module is supported on a structural floor below a suspension floor.

23. A divider wall assembly kit for defining one or more individual spaces, comprising:

a frame assembly configured to be connected to a structural wall, the structural wall having a first end and an opposing second end, a first portion of the frame assembly being configured to extend away from the first end of the structural wall in a direction at least partially opposite the second end of the structural wall, a second portion of the frame assembly being configured to span a portion of at least one face of the structural wall between the first and second ends of the structural wall, wherein the second portion of the frame assembly is secured to the face of the structural wall at one or more points along the spanned portion, the frame assembly comprising:

a first vertical support configured to be positioned adjacent to the first end of the structural wall;

a second vertical support configured to be positioned distant from the structural wall in the direction at least partially opposite the second end of the structural wall a plurality of horizontal supports each configured to extend between the first and second vertical supports having a first end thereof configured for coupling to the first vertical support and a second end thereof configured for coupling to the second vertical support;

a vertical bracket configured to be connected to the second end of the structural wall on a first side face thereof;

a plurality of horizontal supports each configured to extend between the vertical bracket and the first vertical support having a first end thereof configured for coupling to the first vertical support and a second end thereof configured for coupling to the vertical bracket, and one or more panels removably connectable to the frame such that the one or more panels (i) at least partially cover the plurality of horizontal supports configured to extend between the first and second vertical supports and the plurality of horizontal supports configured to extend between the vertical bracket and the first vertical support, and (ii) at least partially conceal the first side face of the structural wall, wherein the plurality of horizontal supports extending between the first and second vertical supports and the plurality of horizontal supports extending between the vertical bracket and the first vertical support each comprise at least one stringer configured to have the one or more panels removably connected thereto.

24. The divider wall assembly kit as recited in claim 23, wherein at least one of the one or more panels is extendable from the vertical bracket to the second vertical support and at least partially conceals the structural wall and the first and second portions of the frame from a vantage point corresponding to the first side face of the structural wall.

25. The divider wall assembly kit as recited in claim 23, wherein the frame assembly further comprises:

a second vertical bracket configured to be connected to the second end of the structural wall on a second side face thereof;

a plurality of horizontal supports each configured to extend between the second vertical bracket and the first vertical support having a first end thereof configured for coupling to the first vertical support and a second end thereof configured for coupling to the second vertical bracket; and one or more panels removably connectable to the frame such that the one or more panels (i) at least partially cover the plurality of horizontal supports configured to extend between the first and second vertical supports and the plurality of horizontal supports configured to extend between the second vertical bracket and the first vertical support, and (ii) at least partially conceal the second side face of the structural wall, wherein the plurality of horizontal supports extending between the first and second vertical supports and the plurality of horizontal supports extending between the second vertical bracket and the first vertical support each comprise at least one stringer positioned on the second side face of the divider wall.

26. The divider wall as recited in claim 25, wherein at least one of the one or more panels extends from the second vertical bracket to the second vertical support and at least partially conceals the structural wall and the first and second portions of the frame from a vantage point corresponding to the second side face of the structural wall.

* * * * *